US008342515B2

(12) United States Patent
Iwata

(10) Patent No.: US 8,342,515 B2
(45) Date of Patent: Jan. 1, 2013

(54) FEEDING DEVICE AND RECORDING APPARATUS

(75) Inventor: Naohiro Iwata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/004,674

(22) Filed: Jan. 11, 2011

(65) Prior Publication Data

US 2011/0169213 A1 Jul. 14, 2011

(30) Foreign Application Priority Data

Jan. 12, 2010 (WO) ..... PCT/JP2010/050230

(51) Int. Cl.
*B65H 1/00* (2006.01)
*B65H 9/16* (2006.01)

(52) U.S. Cl. ..... 271/171; 271/248

(58) Field of Classification Search ..... 271/171, 271/248

See application file for complete search history.

(56) References Cited

U.S. PATENT DOCUMENTS

| | | | | |
|---|---|---|---|---|
| 4,657,239 | A * | 4/1987 | Ikesue et al. | 271/227 |
| 5,713,570 | A * | 2/1998 | Ouchi | 271/242 |
| 6,412,773 | B1 * | 7/2002 | Takagi | 271/171 |
| 6,793,215 | B2 * | 9/2004 | Salomon | 271/171 |
| 7,547,014 | B2 * | 6/2009 | Okuda et al. | 271/171 |
| 7,594,653 | B2 * | 9/2009 | Shiohara et al. | 271/171 |
| 7,913,998 | B2 * | 3/2011 | Okuda et al. | 271/171 |
| 2006/0071388 | A1 * | 4/2006 | Okuda et al. | 271/8.1 |
| 2009/0121412 | A1 * | 5/2009 | Koyanagi | 271/117 |

FOREIGN PATENT DOCUMENTS

| | | | |
|---|---|---|---|
| JP | 5-319584 | A | 12/1993 |
| JP | 2001-39544 | A | 2/2001 |
| JP | 2005-298144 | A | 10/2005 |
| JP | 2007-131422 | A | 5/2007 |
| JP | 2009-137762 | A | 6/2009 |

* cited by examiner

*Primary Examiner* — Patrick Cicchino

(74) *Attorney, Agent, or Firm* — Canon USA Inc. IP Division

(57) ABSTRACT

To achieve high conveying accuracy by reducing back tension on a recording medium being conveyed. A feeding device includes a pressure plate on which recording media are loaded; feeding means for feeding the recording media; a regulating member configured to regulate a position of a side edge of the recording media; supporting means for supporting the regulating member, the supporting means having a bottom portion on which the recording media are partially loaded; and moving means for separating the regulating member from the side edge of the recording media. The feeding means starts to feed the recording medium while the position of the side edge of the recording media is being regulated by the regulating member, and the moving means separates the regulating member from the side edge of the recording media after a conveying means starts to convey the recording medium fed by the feeding means.

16 Claims, 10 Drawing Sheets

FEEDING DEVICE AND RECORDING APPARATUS

BACKGROUND OF THE INVENTION

1. Field of the Invention

The present invention relates to a feeding device that feeds recording media, and also relates to a recording apparatus including the feeding device and recording means that records (prints) images on the recording media.

2. Description of the Related Art

In a feeding device, a tray for loading recording media is provided with guide members that regulate both edges of recording media in the width direction. The device user moves one or both of the guide members to fit the size of recording media loaded, thereby regulating the position of the recording media in the width direction. With this configuration, where the guide members guide both edges of recording media to prevent lateral displacement, it is possible to feed recording media from a feeding unit to a recording unit with high accuracy.

In an inkjet recording apparatus, where a line of recording and conveyance are alternately performed, the accuracy of conveyance of a recording medium in the conveying direction has a significant impact on image quality. During a recording operation, a frictional resistance between guide members that regulate the position of a recording medium in the width direction and the side edges of the recording medium acts as a back tension, affects the accuracy in conveying the recording medium, and contributes to degradation of image quality.

As a solution to this problem, Japanese Patent Laid-Open No. 2007-131422 proposes a recording apparatus having the following configuration. The recording apparatus disclosed in Japanese Patent Laid-Open No. 2007-131422 includes a pressure plate that holds recording media and swings up and down to cause a recording medium to come into contact with and separate from feeding means, and guide members that guides side edges of the recording media loaded on the pressure plate. The pressure plate moves laterally in conjunction with its up-and-down swinging. In conjunction with the movement of the pressure plate, the guide members separate from the side edges of the recording media.

However, in the conventional example disclosed in Japanese Patent Laid-Open No. 2007-131422, since the pressure plate is laterally moved to move the guide members laterally, the recording media loaded on the pressure plate may be laterally moved as the pressure plate moves. In particular, some recording media near the bottom layer of the stack on the pressure plate may be laterally moved, so that poor alignment of the side edges of the recording media may occur. Additionally, if the guide members move toward the poorly aligned recording media, the side edges of the recording media may be folded or scratched.

Accordingly, an object of the present invention is to provide a feeding device that can achieve high conveying accuracy by reducing back tension on a recording medium being conveyed, and can reduce occurrence of poor alignment of side edges of recording media loaded.

SUMMARY OF INVENTION

To solve the problems described above, a feeding device according to the present invention includes a pressure plate on which recording media are loaded; feeding means for feeding each of the recording media loaded on the pressure plate; a regulating member configured to regulate a position of each side edge of the recording media loaded on the pressure plate; supporting means for supporting the regulating member, the supporting means having a bottom portion on which the recording media loaded on the pressure plate are partially loaded; conveying means for conveying the recording medium fed by the feeding means; and moving means for separating the regulating member from the side edge of the recording media loaded on the pressure plate. The feeding means starts to feed the recording medium while the position of the side edge of the recording media is being regulated by the regulating member, and the moving means separates the regulating member from the side edge of the recording media after the conveying means starts to convey the recording medium.

Further features of the present invention will become apparent from the following description of exemplary embodiments with reference to the attached drawings.

DESCRIPTION OF EMBODIMENTS

First Embodiment

Figure 1:
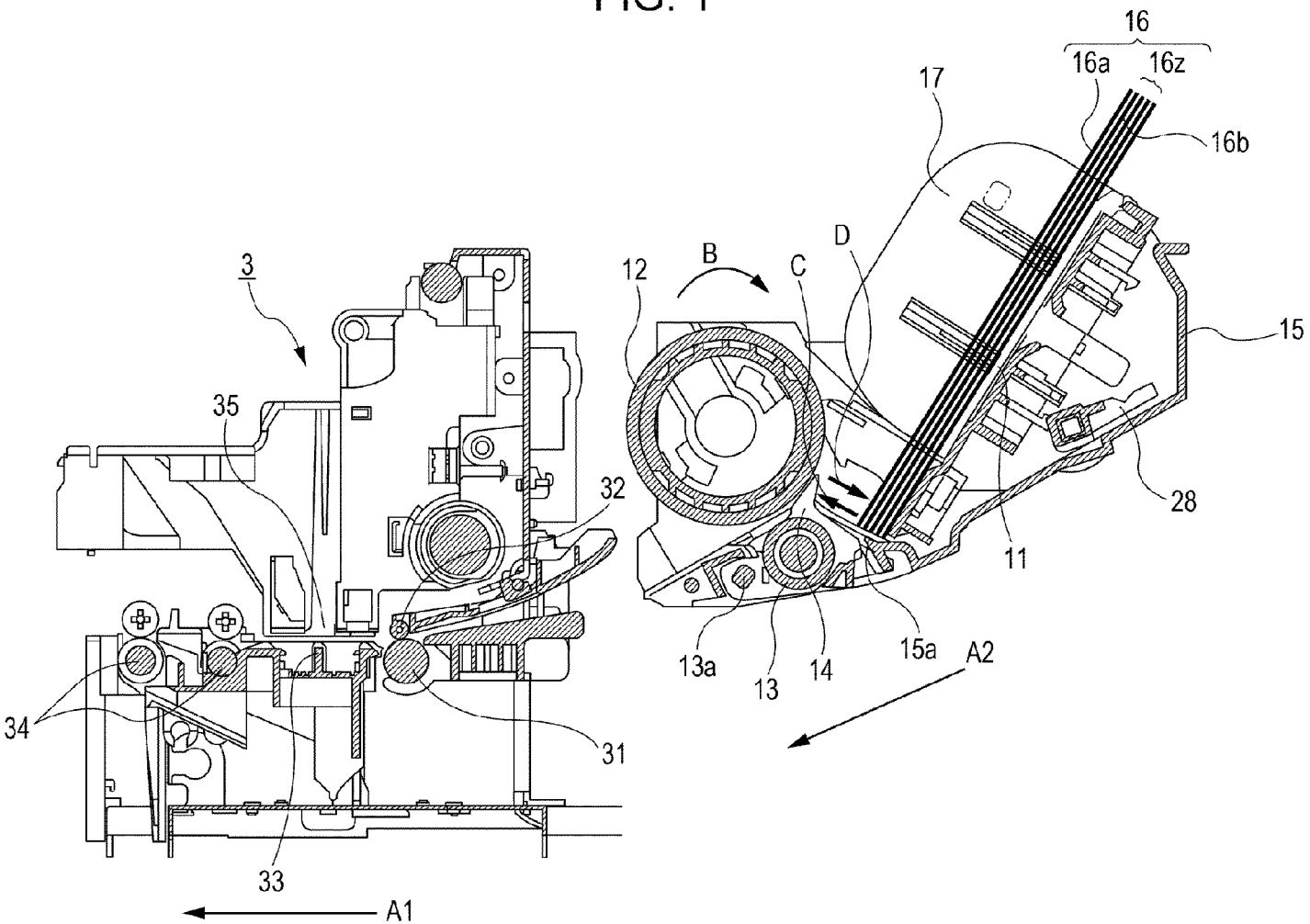
FIG. 1 is a cross-sectional view of an inkjet recording apparatus according to a first embodiment of the present invention.

Hereinafter, embodiments of the present invention will be described in detail with reference to the drawings. FIG. 1 is a cross-sectional view of an inkjet recording apparatus according to an embodiment of the present invention. The inkjet recording apparatus 1 includes a feeding unit 2 and a recording unit 3. In FIG. 1, the left side corresponds to the front of the apparatus and the direction indicated by reference character A1 corresponds to the recording-medium conveying direction.

The feeding unit is disposed in the upper rear part of the main body of the inkjet recording apparatus 1. The recording unit 3 is disposed in front of the feeding unit 2 in the apparatus main body. A recording medium loaded in the feeding unit is fed by feeding means of the feeding unit 2 in the direction A2 in FIG. 1 to reach the recording unit 3. Then, the recording medium is subjected to a recording operation while being conveyed by conveying means mounted in the recording unit 3. After completion of the recording operation, the recording medium is discharged outside the apparatus from the front of the recording unit 3.

(Feeding Unit)

Figure 2A:
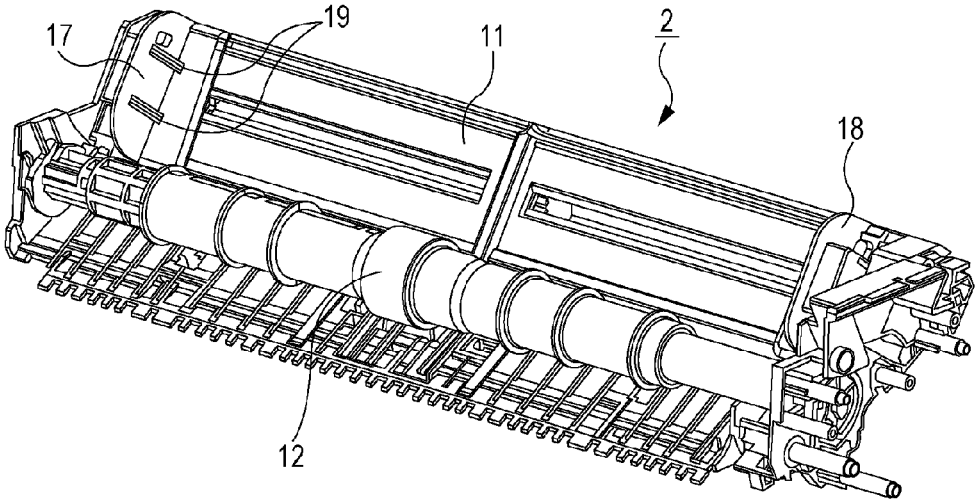
FIG. 2A and FIG. 2B are perspective views of a feeding unit.
Figure 2B:
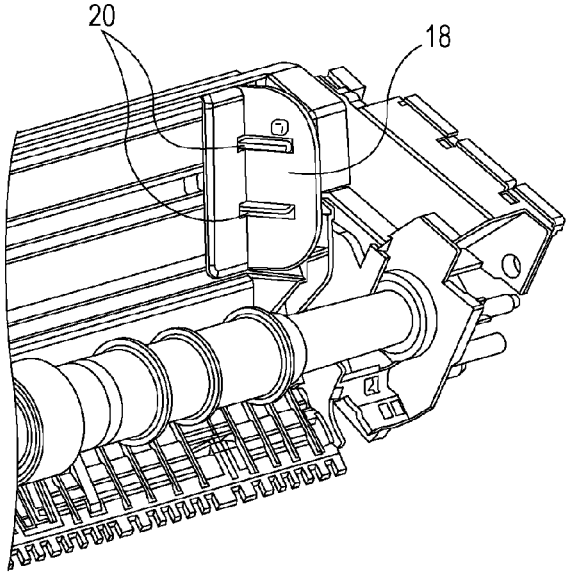

Next, the feeding unit according to the embodiment of the present invention will be described with reference to FIGS. 2A and 2B to FIGS. 4A and 4B. FIG. 2A and FIG. 2B are schematic perspective views of the feeding unit 2. The feeding unit 2 includes a pressure plate 11, a feeding roller 12, a separation roller 13, a sheet return lever 14, and a feeding frame 15 that supports the pressure plate 11, the feeding roller 12, the separation roller 13, and the sheet return lever 14. Reference numeral 16 in FIG. 1 denotes a sheet stack, which is a stack of recording media.

The pressure plate 11 is supported pivotally about a position near its upper end by the feeding frame 15. The pressure plate 11 pivots to cause its lower end to come into contact with and separate from the feeding roller 12. The feeding roller 12, having a round shape, is rotatably supported by the feeding frame 15 and disposed opposite the lower end portion of the pressure plate. As illustrated in FIG. 2A, the feeding roller 12 is disposed opposite substantially the center portion of the pressure plate 11 in the width direction of the sheet holding portion. The feeding roller 12 performs feeding while being in contact with the center portion of the sheet stack 16 in the width direction, the sheet stack 16 being loaded on the pressure plate 11.

The pressure plate 11 is provided with left and right guides 17 and 18 that guide both sides of the sheet stack 16. The left and right guides 17 and 18 are provided with left and right sheet-side-edge guide members. As illustrated in FIG. 2A, the left guide 17 is provided with a left sheet-side-edge guide member 19 serving as a regulating member. As illustrated in FIG. 2B, the right guide 18 is provided with a right sheet-side-edge guide member 20 serving as a regulating member. The left and right guides 17 and 18 are mounted on the pressure plate 11 such that they are movable relative to the pressure plate 11 in the direction crossing the sheet conveying direction, that is, in the sheet width direction. The left and right guides 17 and 18 can be moved to fit the size of sheets loaded.

Figure 3:
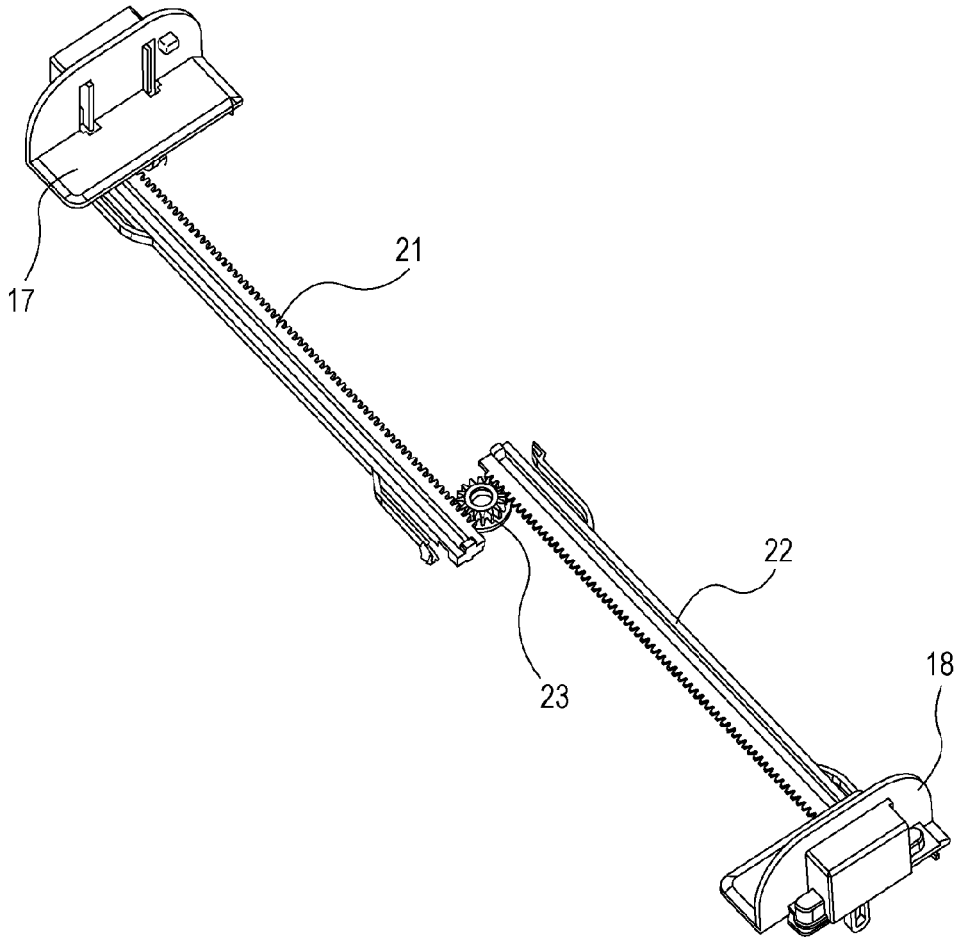
FIG. 3 is a perspective view illustrating a connected state of left and right guides.

FIG. 3 is a schematic perspective view illustrating a mechanism of connection between the left and right guides 17 and 18. As illustrated in FIG. 3, the left and right guides 17 and 18 are integrally movably fastened to rack-like left and right guide arm members 21 and 22, respectively. The rack portions formed on the left and right guide arm members 21 and 22 engage with a guide member gear 23. Although not illustrated in FIG. 3, the guide member gear 23 is mounted on the back side of the pressure plate 11 illustrated in FIG. 2A. Therefore, in the present apparatus, when one of the left and right guide members is moved, the other is moved in conjunction therewith, so that they can be moved to fit the size of sheets. The distance between the left and right guides 17 and 18 is adjusted to be the same as the length of the feeding roller 12. Therefore, when a sheet stack of a different size is loaded on the pressure plate 11, adjusting the position in the width direction using the left and right guides 17 and 18 allows the feeding roller 12 to move to substantially the center of the sheet stack in the width direction. Thus, in the operation of feeding the sheet stack 16, a difference in sheet conveying accuracy between the left and right sides can be reduced.

As illustrated in FIG. 1, the separation roller 13 is disposed below the feeding roller 12 and downstream of the pressure plate 11. The separation roller 13 is pivotally supported by a separation roller arm 48 swingably supported by an arm shaft 13*a*. When the separation roller arm 13*b* swings, the separation roller 13 can move between a position at which it is in contact with the feeding roller 12 and a position at which it is spaced from the feeding roller 12. The separation roller 13 is given a substantially constant rotational resistance by a torque limiter mechanism. Therefore, when only one sheet is fed between the feeding roller 12 and the separation roller 13, the separation roller 13 is rotated while applying a conveying load to the sheet. When there are a plurality of sheets between the feeding roller 12 and the separation roller 13, the separation roller 13 stops without being rotated by a sliding action between sheets. The separation roller 13 thus performs a separating operation to block sheets, except that fed to the feeding roller 12, from advancing.

As illustrated in FIG. 1, the sheet return lever 14 is disposed near the separation roller 13. The sheet return lever 14 swings about its lower end in the sheet conveying direction and its opposite direction. During the separating operation of the feeding roller 12 and the separation roller 13, the sheet return lever 14 swings downstream in the conveying direction and retracts below the conveying path. When the separation roller 13 is separated from the feeding roller 12, the sheet return lever 14 pivots about its lower end clockwise to push back the leading edges of sheets staying near the separation roller 13. The pushed-back second and following sheets are returned to a predetermined position on the pressure plate 11 and the feeding frame 15.

(Recording Unit)

The recording unit 3 illustrated in FIG. 1 includes a conveying roller 31 serving as conveying means, a driven roller 32 rotated as the conveying roller 31 rotates, a platen 33, eject rollers 34, and a recording head 35 serving as recording means. When the leading edge of a sheet fed from the feeding unit reaches the conveying roller 31, the sheet is conveyed in the recording unit while being nipped between the conveying roller 31 and the driven roller 32. When the leading edge of the sheet reaches the eject rollers 34, the sheet is conveyed by both the conveying roller 31 and the eject rollers 34 while being subjected to recording by the recording means 35.

(Feeding and Recording Operations)

Next, a series of feeding and recording operations will be described. As illustrated in FIG. 1, in a standby state, the pressure plate 11 is spaced from the feeding roller 12. In this state, the apparatus user places the sheet stack 16 on the pressure plate 11 as illustrated in FIG. 1. The leading edges of sheets in the sheet stack 16 are aligned by being brought into contact with a sheet-leading-edge contact portion 15*a* of the feeding frame 15. Then, the left and right guides 17 and 18 are moved to bring the left and right sheet-side-edge guide members 19 and 20 into contact with the left and right side edges of the sheet stack 16, respectively. The position of the sheet stack 16 is thus regulated. In this state, the feeding roller 12 comes into contact with substantially the center of the sheet stack 16 in the width direction.

When the feeding operation starts, the feeding roller 12 starts to rotate in the direction indicated by arrow B in FIG. 1. Then, the pressure plate 11 swings in the direction indicated by reference character C to press an uppermost sheet 16*a* in the sheet stack 16 loaded on the pressure plate 11 against the outer surface of the feeding roller 12.

As the feeding roller 12 rotates further in the direction indicated by arrow B, the sheet 16*a* in contact with the outer surface of the feeding roller 12 is fed in the feeding direction. As described above, a remaining sheet stack 16*z* under the sheet 16*a*, the remaining sheet stack 16*z* being not directly in contact with the feeding roller 12, is subjected to driven rotational resistance of the separation roller 13. Then, the remaining sheet stack 16*z* not directly in contact with the feeding roller 12 is separated from the uppermost sheet 16*a* and blocked from advancing beyond the contact surface between the outer surface of the feeding roller 12 and the outer surface of the separation roller 13.

When the feeding roller 12 rotates further in the direction of arrow B to a predetermined rotational position, the pressure plate 11 swings in the direction of arrow D. At this point, most sheets in the sheet stack 16 are returned to a predetermined position on the pressure plate 11 and the feeding frame 15. The sheet return lever 14 that has swung downstream in the conveying direction to retract below the conveying path pivots clockwise to push back the leading edges of sheets staying near the separation roller 13. Thus, the sheet return lever 14 returns the second and following sheets 16*z* to a predetermined position on the pressure plate 11 and the feeding frame 15.

Since the pressure plate 11 is separated from the feeding roller 12, a back tension applied from the pressure plate 11 and the feeding roller 12 to the sheets can be reduced.

When the feeding roller 12 further rotates, the leading edge of the sheet 16*a* separated from the sheet stack reaches the nip between the conveying roller 31 and the driven roller 32 illustrated in FIG. 1. With the conveying roller 31 stopped or rotated backward, the leading edge of the uppermost sheet 16*a* is pressed against the nip between the conveying roller 31 and the driven roller 32. This allows a skew correcting operation which aligns the leading edge of the sheet 16*a* to be perpendicular to the sheet conveying direction. Since the left and right sheet-side-edge guide members 19 and 20 of the left and right guides 17 and 18 on the pressure plate regulate the left and right side edges of the sheet 16*a*, it is possible to perform the skew correcting operation for alignment of the leading edge while preventing degradation of positional accuracy in the width direction of the uppermost sheet 16*a*.

After completion of the skew correcting operation, the sheet 16*a* is conveyed by rotation of the conveying roller 31 in the sheet conveying direction while being nipped by the conveying roller 31 and the driven roller 32. When the sheet 16*a* reaches a recording-operation start position, the recording head 35 starts a recording operation.

After the conveying roller 31 starts to convey the sheet 16*a* and before the recording head 35 starts a recording operation, the separation roller 13 is separated from the feeding roller 12 by the configuration of a drive system described below. At the same time, transmission of a driving force to the feeding roller 12 is stopped. Therefore, even if the sheet 16*a* being conveyed by the conveying roller 31 is in contact with the feeding roller 12, the feeding roller 12 is rotated by movement of the sheet 16*a* (in a so-called dragged state). Therefore, a back tension applied from the feeding roller 12 and the separation roller 13 to the sheet 16*a* can be reduced.

Also, after the conveying roller 31 starts to convey the sheet 16*a* and before the recording means 35 starts a recording operation, the left and right sheet-side-edge guide members 19 and 20 move in directions away from the side edges of the sheet 16*a*. Therefore, a back tension applied to the sheet 16*a* by frictional resistance offered to the sheet side edges by the left and right sheet-side-edge guides 19 and 20 can be reduced.

When the sheet 16*a* is conveyed by the conveying roller 31 to reach the recording-operation start position, the conveying roller 31 temporarily stops conveying the sheet 16*a*. In this state, the recording means 35 reciprocates over the print surface of the sheet 16*a* in the direction crossing the conveying direction. In this process, the recording means 35 performs a line of recording operation by discharging ink droplets. Upon completion of a line of recording operation, the sheet 16*a* is conveyed by a necessary amount by the conveying roller 31 and stopped. Then, again, the recording means 35 reciprocates while performing a recording operation by discharging ink droplets. By repeating this motion, the recording operation can be done over substantially the entire surface of the sheet.

As described above, in the recording apparatus according to the embodiment of the present invention, at a predetermined time after the feeding roller 12 starts a feeding operation and before the recording means 35 starts a recording operation, the pressure plate 11 is separated from the feeding roller 12. After the sheet 16*a* reaches the conveying roller 31 and the conveying roller 31 starts to convey the sheet 16*a* and before the recording means 35 starts a recording operation, the separation roller 13 is separated from the feeding roller 12 and transmission of a driving force to the feeding roller 12 is stopped. Also, the left and right sheet-side-edge guides 19 and 20 are separated from the sheet side edges, so that frictional resistance offered to the sheet side edges is reduced. Thus, a back tension applied to the sheet can be reduced and conveying accuracy can be improved.

Upon completion of the recording operation on the sheet 16*a* as described above, a feeding operation of feeding the second sheet 16*b* starts. After completion of the recording operation on the first sheet 16*a* and before feeding of the second sheet 16*b* starts, the left and right sheet-side-edge guide members 19 and 20 spaced from the side edges of the second sheet 16*b* move in directions toward the side edges of the second sheet 16*b*. Therefore, the second sheet 16*b* is fed by the feeding roller 12 with the positional accuracy in the width direction maintained.

(Guides)

Figure 4A:
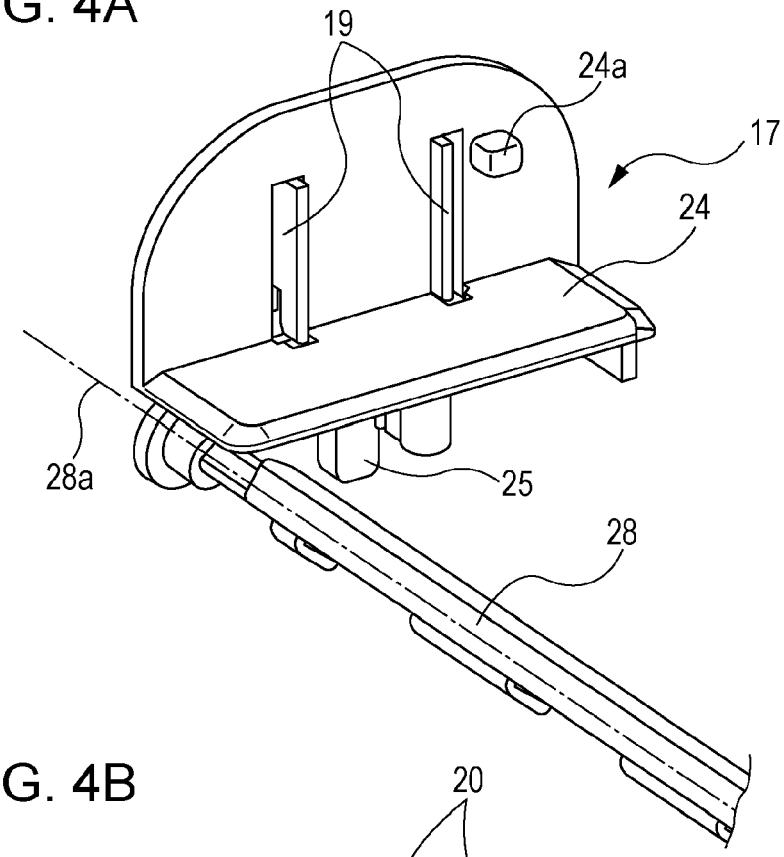
FIG. 4A and FIG. 4B are perspective views of guides.
Figure 4B:
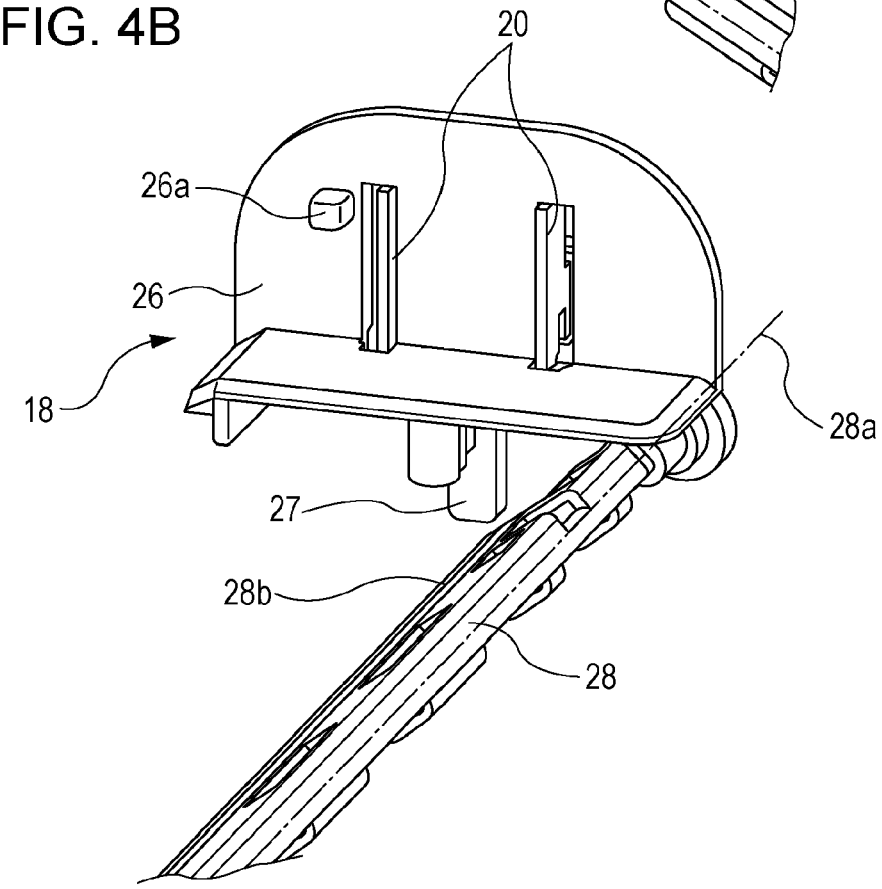

FIG. 4A and FIG. 4B are perspective views illustrating the left and right guides 17 and 18 in a first state. As illustrated in FIG. 4A, the left guide 17 includes the left sheet-side-edge guide member 19, a left guide base 24, and a left-side-edge guide shift member 25. The left guide base 24 has a sheet-height regulating rib 24*a* formed integrally therewith. Similarly, the right guide 18 illustrated in FIG. 4B includes the right sheet-side-edge guide member 20, a right guide base 26, and the right-side-edge guide shift member 27. The right guide base 26 has a sheet-height regulating rib 26*a* formed integrally therewith.

Figure 5A:
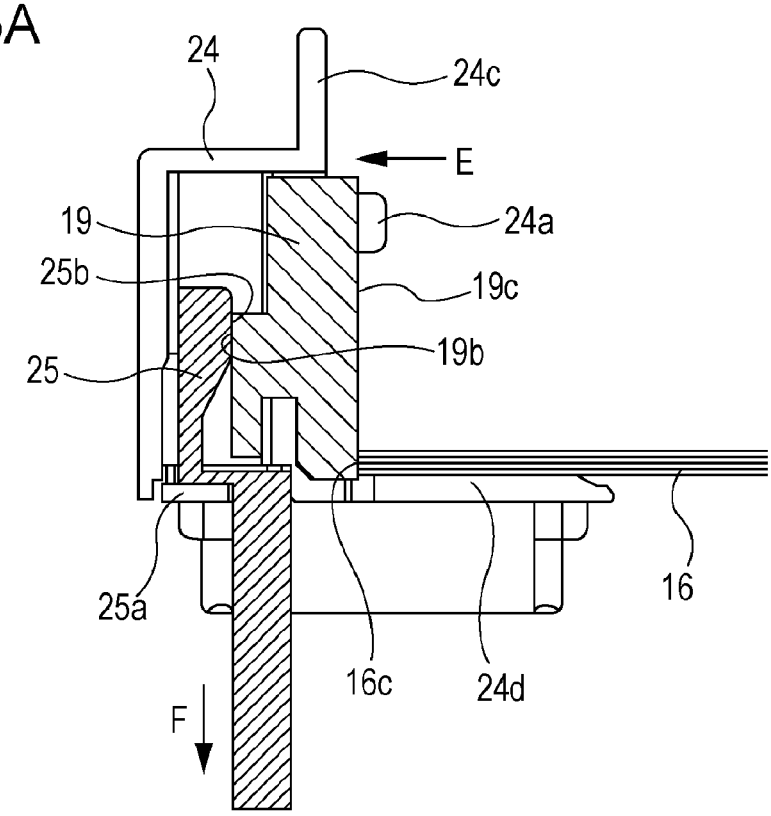
FIG. 5A and FIG. 5B are cross-sectional views of a guide.
Figure 5B:
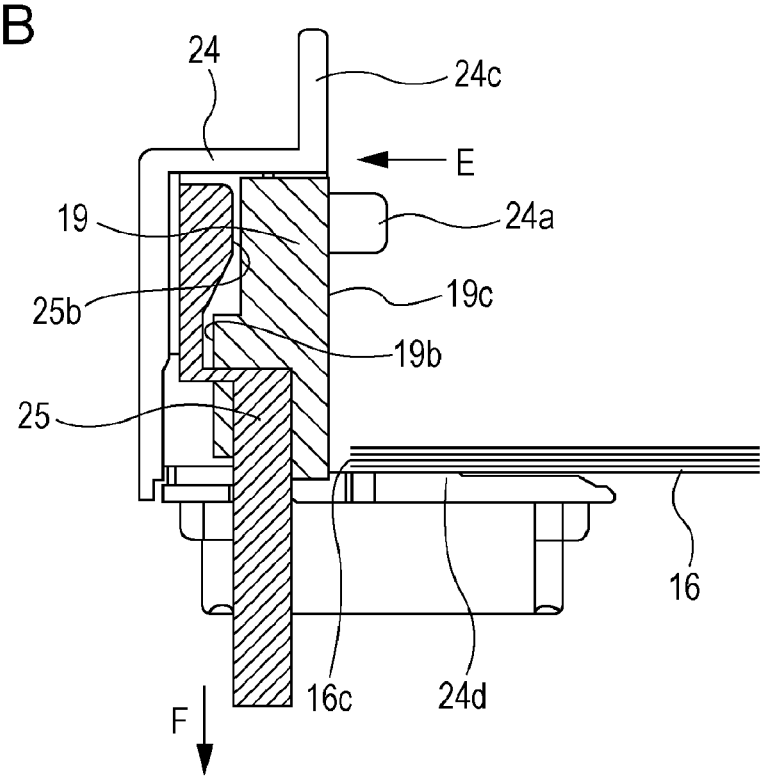
Figure 6A:
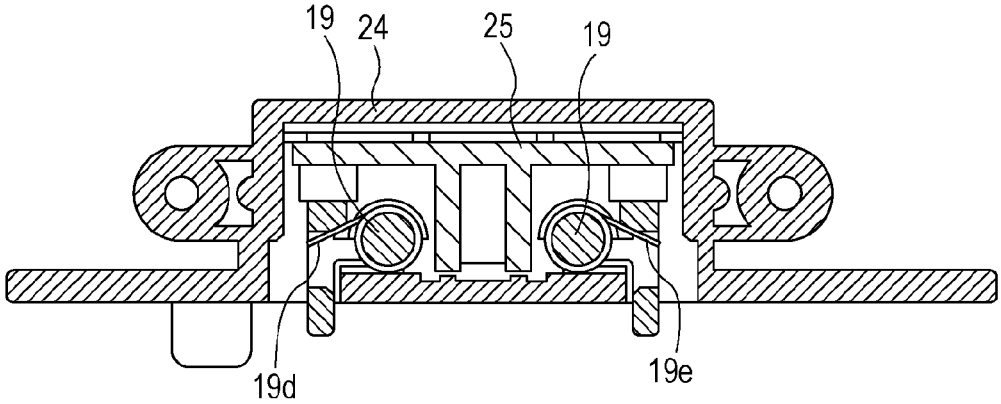
FIG. 6A and FIG. 6B are cross-sectional views of a guide.
Figure 6B:
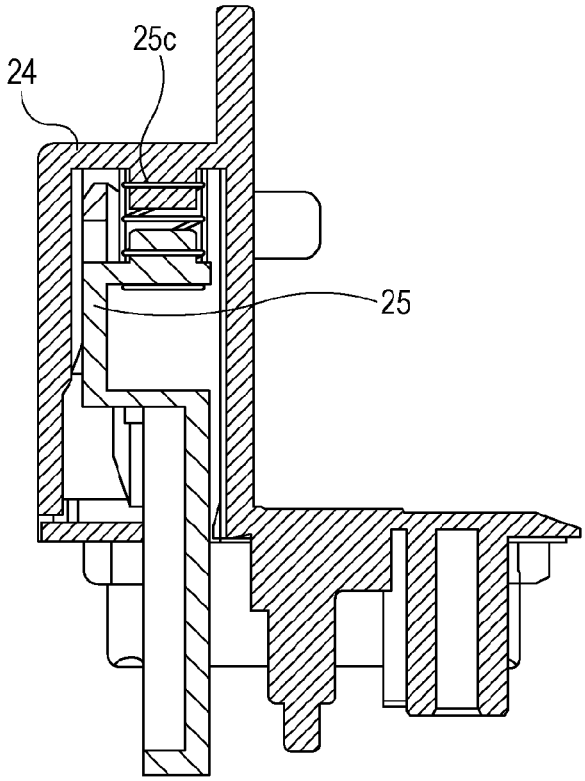

FIG. 5A is a schematic cross-sectional view of the left guide 17 in the first state, and FIG. 5B is a schematic cross-sectional view of the left guide 17 in a second state. The left guide 17 will now be described with reference to FIG. 5A and FIG. 5B. Note that the right guide 18 has the same configuration as that of the left guide 17. Referring to FIG. 5A and FIG. 5B, the left guide base 24 has a bottom portion 24*d* that is slidably in contact with the pressure plate 11 and keeps the guide base 24 in an upright position relative to the pressure plate 11. An edge of a stack of the recording media 16 loaded on the pressure plate 11 is partially placed on the bottom portion 24*d*. The left guide base 24 is supporting means that supports the left sheet-side-edge guide member 19 serving as a regulating member that regulates the position of a left side edge 16*c* of the stack of the recording media 16. The left sheet-side-edge guide member 19 is mounted on the left guide base 24 movably in the sheet width direction (i.e., in the left-right direction in FIG. 5A and FIG. 5B). The left-side-edge guide shift member 25 is mounted on the left guide base 24 movably in the up-down direction. FIG. 6A is a cross-sectional view of the guide 17, the view being taken along a plane parallel to a sheet holding surface of the pressure plate 11. Reference numerals 19*d* and 19*e* in FIG. 6A denote springs serving as biasing means that bias the left sheet-side-edge guide member 19 in the direction indicated by reference character E in FIG. 5A and FIG. 5B, that is, in a direction away from the edge of the stack of the recording media 16. The left-side-edge guide shift member 25 is subjected to biasing force of a spring 25*c* (see FIG. 6B), which is second biasing means, in a first direction indicated by reference character F in FIG. 5A and FIG. 5B.

In the first state illustrated in FIG. 5A, the left-side-edge guide shift member 25 is subjected to biasing force of the spring 25*c* in the direction of reference character F. This brings a guide-base contact surface 25*a* of the left-side-edge guide shift member 25 into contact with the left guide base 24. The position of the left-side-edge guide shift member 25 is thus defined. In the case of the left sheet-side-edge guide member 19, which is subjected to biasing force in the direction of reference character E, a shift-member contact surface 19*b* of the left sheet-side-edge guide member 19 comes into contact with a side-edge guide contact surface 25*b* of the left-side-edge guide shift member 25. The position of the left sheet-side-edge guide member 19 in the left-right direction in FIG. 5A is thus defined. In this state, the position of the left sheet-side-edge guide member 19 is defined in a state where a sheet-side-edge contact portion 19*c* of the left sheet-side-edge guide member 19 protrudes by a substantially fixed amount from a guide side surface 24*c* of the left guide base 24, so that the sheet-side-edge contact portion 19*c* of the left sheet-side-edge guide member 19 comes into contact with the sheet-stack side edge 16*c*.

In the second state illustrated in FIG. 5B, the left-side-edge guide shift member 25 is moved in a second direction opposite the direction of reference character F in FIG. 5B, against the biasing force acting in the direction F. In this state, the side-edge guide contact surface 25*b* of the left-side-edge guide shift member 25 is separated from the shift-member contact surface 19*b* of the left sheet-side-edge guide member 19. Thus, the left sheet-side-edge guide member 19 is subjected to biasing force of the springs 19*d* and 19*e* in the direction indicated by reference character E and moved leftward in FIG. 5B. The sheet-side-edge contact portion 19*c* of the left sheet-side-edge guide member 19 is moved until it is substantially flush with the guide side surface 24*c* of the left guide base 24. Thus, the sheet-side-edge contact portion 19*c* having been in contact with the sheet-stack side edge 16*c* is separated therefrom. As described above, the guide shift member 25 serves as a cam member having the side-edge guide contact surface 25*b* which serves as a cam surface.

The first state illustrated in FIG. 4A, FIG. 4B, and FIG. 5A corresponds to a configuration during sheet loading and feeding, while the second state illustrated in FIG. 5B corresponds to a configuration of the left guide member during a recording operation.

As illustrated in FIG. 5B, in a recording operation, the left sheet-side-edge guide member 19 having been in contact with the sheet-stack side edge 16*c* moves in the direction away from the sheet-stack side edge 16*c*. However, the guide lower surface 24*d* of the left guide base 24, the guide lower surface 24*d* being partially in contact with the lower surface of the sheet stack 16, does not move relative to the sheet stack 16. With this configuration, it is possible to prevent the problem where sheets near the bottom of the sheet stack 16 are slightly moved in the width direction by lateral force and thus the left and right edges of sheets in the sheet stack 16 are not aligned properly. Additionally, when the left sheet-side-edge guide member 19 moves in the direction toward the sheet-stack side edge 16*c* for feeding of the second and following sheets described below, the left and right edges can be kept aligned. Therefore, it is possible to prevent the problem where sheet side edges poorly aligned are folded, scratched, etc.

The height regulating rib 24*a* of the left guide base 24 is formed integrally with the left guide base 24. Thus, even when the left sheet-side-edge guide member 19 moves in the direction away from the sheet-stack side edge 16*c*, the height regulating rib 24*a* does not move laterally relative to the sheet stack 16. Therefore, after the uppermost sheet 16*a* is fed, the second sheet is not subjected to lateral force. With this configuration, as in the case of the guide lower surface 24*d* of the left guide base 24, it is possible to prevent the problem where the left and right edges of sheets in the sheet stack 16 are not properly aligned and are folded, scratched, etc.

Because of its original purpose of regulating the height of the sheet stack 16, the height regulating rib 24*a* protrudes inward in the sheet width direction (i.e., rightward in FIG. 5A) from the guide side surface 24*c* of the left guide base 24. With this configuration, it is difficult to avoid the following usability problems. For loading of sheets on the pressure plate, the distance between the left and right guides 17 and 18 may be adjusted to the width of the sheet stack 16 before the sheet stack 16 is loaded on the pressure plate. This loading procedure can often take place, because a stack of sheets having the same size as that temporarily set is loaded this way. In this case, the sheet stack 16 needs to pass beyond the height regulating rib 24*a* in the process of being loaded onto the pressure plate. Therefore, if the height regulating rib 24*a* protrudes significantly from the guide side surface 24*c* of the left guide base 24, the edge of the sheet stack 16 may be folded or scratched. If some or all sheets in the sheet stack fail to pass beyond the height regulating rib 24*a* and remain on the height regulating rib 24*a*, a failure in conveyance may occur. Therefore, the height regulating rib 24*a* of the left guide base 24 is preferably configured such that the amount of its protrusion from the guide side surface 24*c* is minimized.

When the left guide 17 is moved away from the edge of the sheet stack 16, it is necessary to prevent that the height regulating rib 24*a* is separated from the edge of the sheet stack 16. However, as described above, a significant protrusion of the height regulating rib 24*a* from the guide side surface 24*c* may affect usability in loading the sheet stack 16 on the pressure plate and performance in conveyance. In the left guide 17 according to the embodiment of the present invention, however, the height regulating rib 24*a* of the left guide base 24 does not move laterally relative to the sheet stack 16 as described above. This configuration has no negative impact on usability in loading the sheet stack and performance in conveyance.

Although the configuration of only the left guide 17 is illustrated in FIG. 5A and FIG. 5B, the right guide 18 has the same configuration as that of the left guide 17.

As described above, in the feeding unit according to the embodiment of the present invention, although the left and right side-edge guide members 19 and 20 are separated from the sheet-stack side edges to reduce frictional resistance of the sheet-stack side edges, the pressure plate does not move in either the width or up-down direction. With this configuration, since it is not necessary to needlessly move the pressure plate, stable loading of sheets can be achieved.

(Moving Means for Sheet-Side-Edge Guide)

Figure 7:
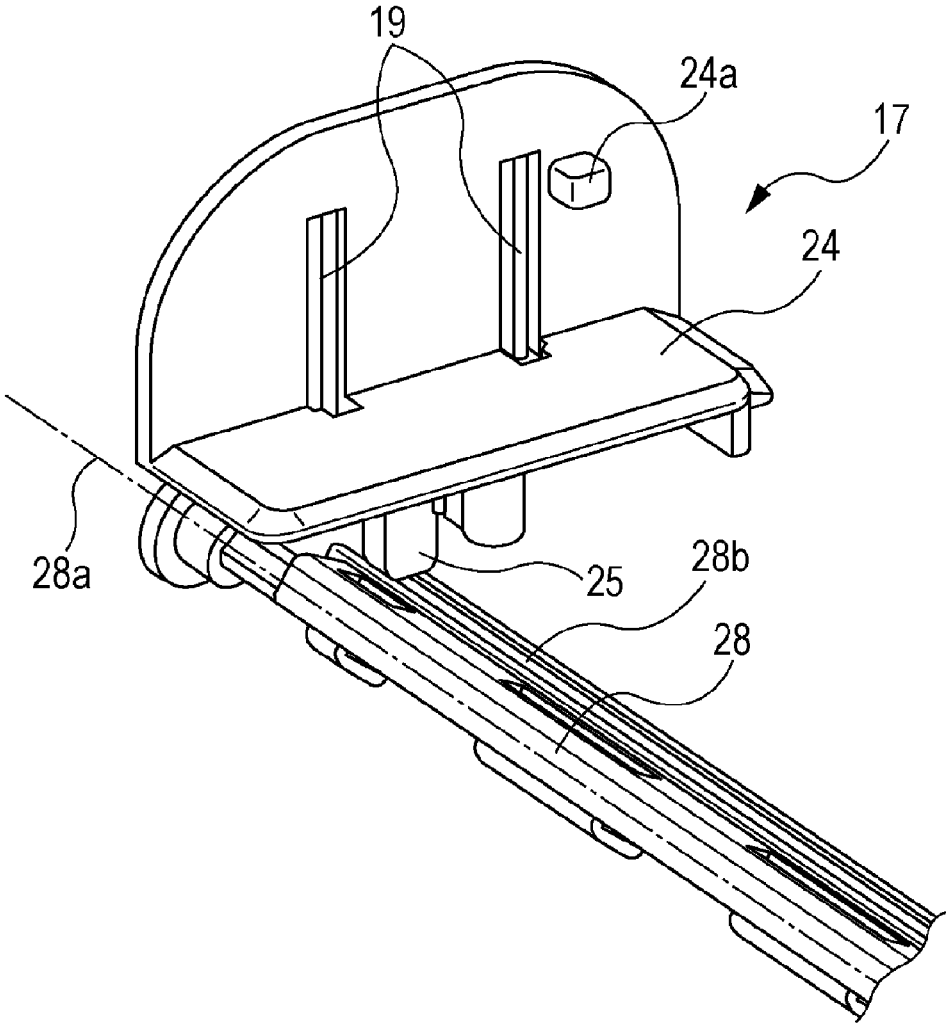
FIG. 7 is a perspective view of a guide.

Moving means for moving the left sheet-side-edge guide member 19 will now be described with reference to FIG. 4A and FIG. 7. FIG. 7 is a schematic perspective view of the left guide 17 in the second state. Referring to FIG. 4A and FIG. 7, a guide shift lever 28 serving as a cam-member moving member is a lever member pivotally supported on a pivot axis 28*a*. Although not illustrated in FIG. 4A and FIG. 7, the guide shift lever 28 is pivotally supported by the feeding frame 15 illustrated in FIG. 1.

In FIG. 4A, the guide shift lever 28 is spaced from the left-side-edge guide shift member 25. This means that the left guide 17 is in the state of FIG. 5A. That is, the shift-member contact surface 19*b* of the left sheet-side-edge guide member 19 is in contact with the side-edge guide contact surface 25*b* of the left-side-edge guide shift member 25. Therefore, the position of the left sheet-side-edge guide member 19 is defined in a state where the sheet-side-edge contact portion 19*c* of the left sheet-side-edge guide member 19 protrudes by a substantially fixed amount from the guide side surface 24*c* of the left guide base 24, so that the sheet-side-edge contact portion 19*c* of the left sheet-side-edge guide member 19 is in contact with the sheet-stack side edge 16*c*.

Referring to FIG. 7, pivoting of the guide shift lever 28 about the pivot axis 28*a* brings a guide-shift pressing portion 28*b* of the guide shift lever 28 into contact with the lower surface of the left-side-edge guide shift member 25, and thereby raises the left-side-edge guide shift member 25. This means that the left guide 17 is in the state of FIG. 5B. That is, as illustrated in FIG. 5B, the left-side-edge guide shift member 25 moves upward against the biasing force of the spring 25*c*. This causes the side-edge guide contact surface 25*b* of the left-side-edge guide shift member 25 to separate from the shift-member contact surface 19*b* of the left sheet-side-edge guide member 19. The sheet-side-edge contact portion 19*c* of the left sheet-side-edge guide member 19 is moved until it is substantially flush with the guide side surface 24*c* of the left guide base 24. Thus, the sheet-side-edge contact portion 19*c* of the left sheet-side-edge guide member 19, the sheet-side-edge contact portion 19*c* having been in contact with the sheet-stack side edge 16*c*, is separated from the sheet-stack side edge 16*c*.

The pivot axis 28*a* of the guide shift lever 28 illustrated in FIG. 4A and FIG. 7 is parallel with the sheet width direction in which the left and right guides 17 and 18 are moved on the pressure plate. The guide-shift pressing portion 28*b* of the guide shift lever 28 is disposed to correspond to a region where the lower surfaces of the left and right side-edge guide shift members 25 and 27 (see FIG. 4A and FIG. 4B) are moved as the left and right guides 17 and 18 are moved in the sheet width direction on the pressure plate. Therefore, regardless of the positions of the left and right guides 17 and 18 on the pressure plate, the left and right side-edge guide shift members 25 and 27 can be moved in the up-down direction by causing the guide shift lever 28 to pivot. Thus, regardless of the positions of the left and right guides 17 and 18 on the pressure plate, the left and right sheet-side-edge guides 19 and 20 can come into contact with and separate from the sheet-stack side edges.

The region where the left and right side-edge guide shift members 25 and 27 are moved is substantially parallel with the pivot axis 28*a* of the guide shift lever 28. Thus, the guide-shift pressing portion 28*b* of the guide shift lever has a consistent cross-sectional shape along the sheet width direction. Therefore, regardless of the positions of the left and right guides 17 and 18 on the pressure plate 11 in the sheet width direction, the left and right sheet-side-edge guide members 19 and 20 can be moved without displacement.

As described above, in the feeding unit according to the embodiment of the present invention, to reduce frictional resistance of the sheet-stack side edges, the left and right sheet-side-edge guides 19 and 20 are separated from the sheet-stack side edges by causing the guide shift lever 28 to pivot. For movement of the left and right guides 17 and 18 on the pressure plate, the arm members 21 and 22 and the guide member gear 23 are arranged as illustrated in FIG. 3. However, for separation from the sheet-stack side edges, only the left and right sheet-side-edge guide members 19 and 20 are moved and the left and right guide bases 24 and 26 are not moved. Therefore, the arm members 21 and 22 do not move and the guide member gear 23 does not rotate. Thus, the left and right sheet-side-edge guide members 19 and 20 are separated from the sheet-stack side edges by moving means different from that for moving the left and right guide members on the pressure plate. Therefore, sliding resistance of the arm members 21 and 22 and the guide member gear 23, which are moving means for moving the left and right guide members on the pressure plate, and sliding resistance of the arm members 21 and 22 with the pressure plate 11 can be set to values that are appropriate in terms of usability for the apparatus user.

As illustrated in FIG. 1, the guide shift lever 28 is disposed opposite the sheet holding surface of the pressure plate 11. That is, in FIG. 4A and FIG. 4B, the guide shift lever 28 extends across the whole width of the pressure plate 11. Therefore, it is possible to mount a mechanism for separating the left and right sheet-side-edge guides from the sheet-stack side edges without affecting the overall size of the apparatus.

(Drive Configuration)

Figure 8:
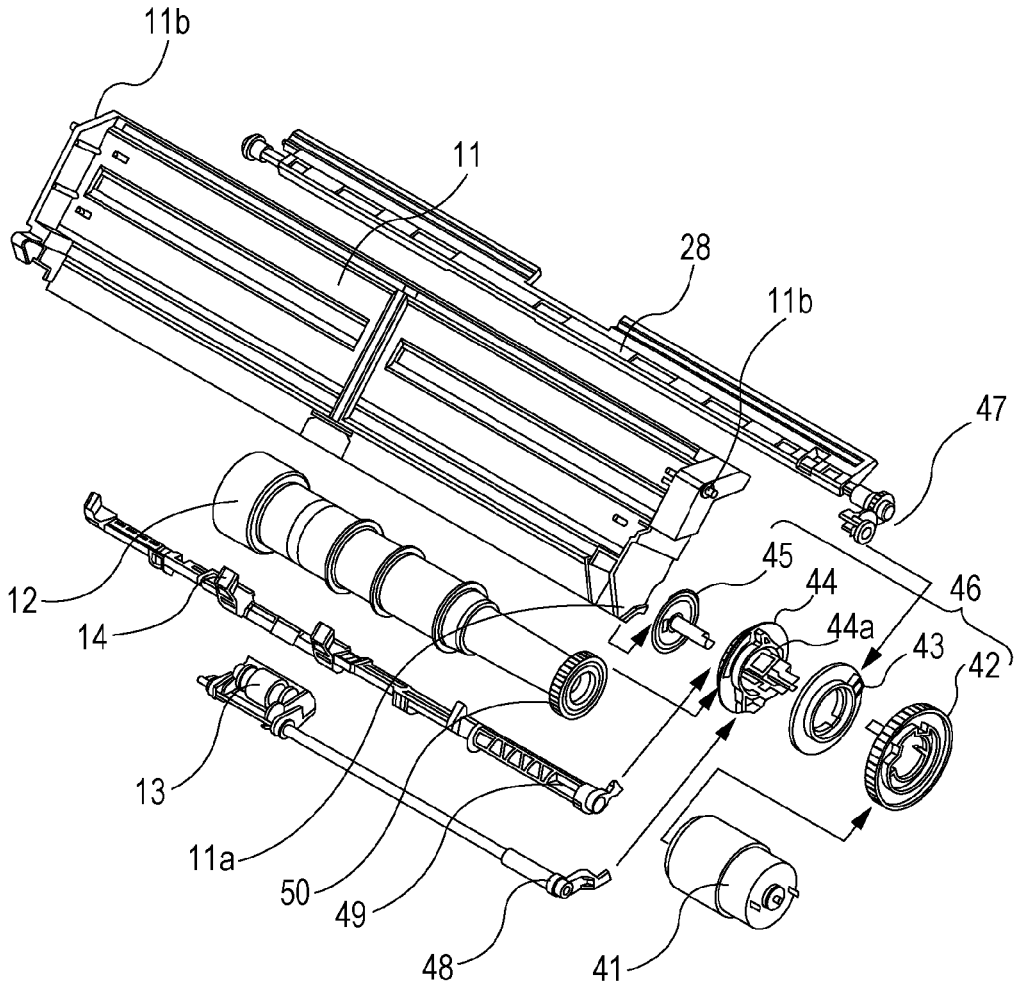
FIG. 8 is a perspective view of a feeding-unit drive system.
Figure 9:
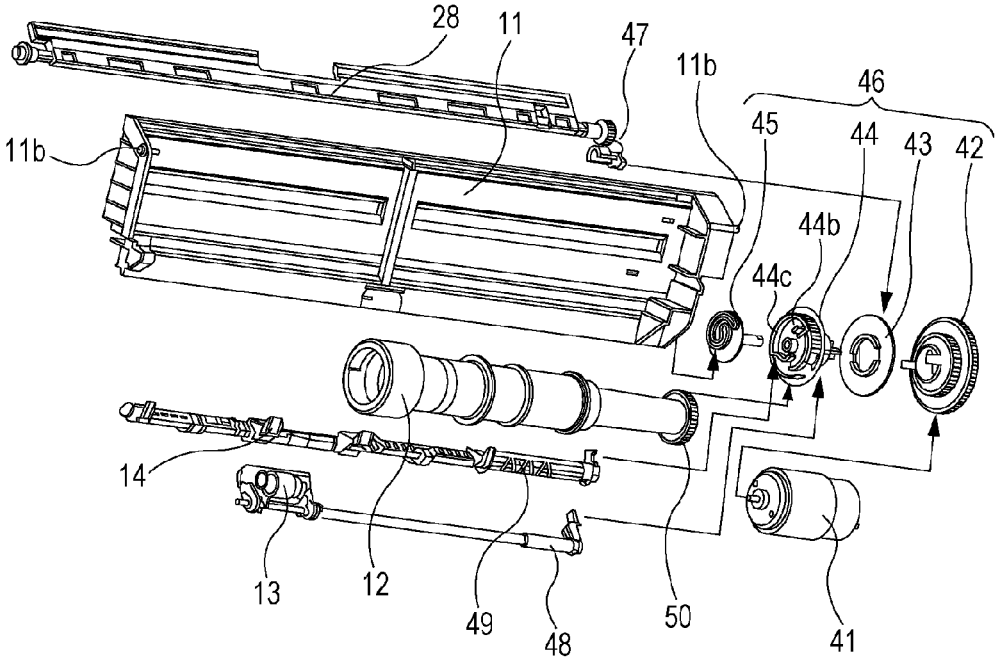
FIG. 9 is a perspective view of a feeding-unit drive system.
Figure 10:
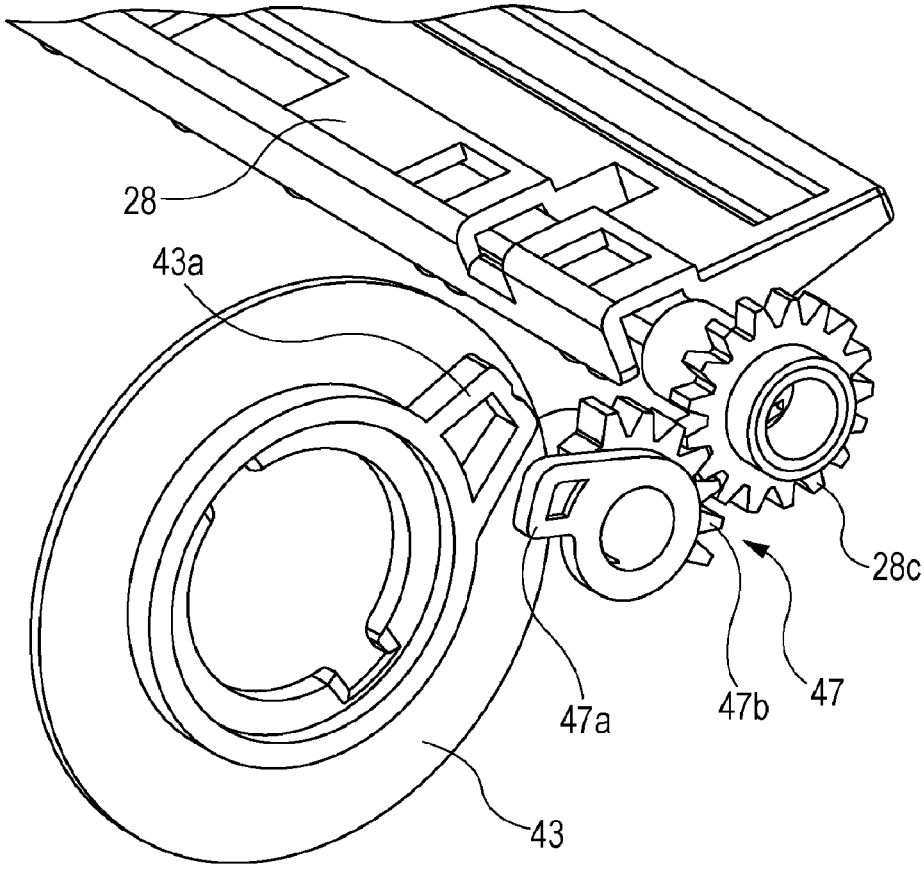
FIG. 10 is a perspective view of a feeding-unit drive system.

A drive system for the feeding unit according to the embodiment of the present invention will now be described. FIG. 8, FIG. 9, and FIG. 10 are schematic perspective views of a drive system for the feeding unit. Reference numeral 41 denotes a feeding drive motor, reference numeral 42 denotes a main-cam input gear, reference numeral 43 denotes a guide-shift lever cam, reference numeral 44 denotes a feeding control cam, and reference numeral 45 denotes a pressure plate cam. The main-cam input gear 42, the guide-shift lever cam 43, the feeding control cam 44, and the pressure plate cam 45 are fitted together by insertion such that they are rotatable in synchronization with each other as an integral main cam unit 46. Reference numeral 47 denotes a guide-shift lever gear unit, reference numeral 48 denotes a separation roller arm, reference numeral 49 denotes a sheet-return lever arm, reference numeral 50 denotes a feeding roller gear, and reference numeral 11*a* denotes a swing cam support 11*a* of the pressure plate 11. The feeding control cam 44 includes a separation roller cam 44*a*, a feeding-roller drive gear 44*b*, and a sheet-return lever cam 44*c*.

As illustrated in FIG. 8 and FIG. 9, when the feeding drive motor 41 serving as a drive source rotates, the main-cam input gear 42 is rotated through a transmission system (not shown). This causes the main cam unit 46 to rotate, and thereby causes the pressure plate cam 45, the feeding control cam 44, and the guide-shift lever cam 43 to rotate.

As the pressure plate cam 45 rotates, the swing cam support 11*a* of the pressure plate is pressed and the pressure plate 11 swings about a pivot center 11*b*.

As the feeding control cam 44 rotates, the following elements are driven. First, the feeding roller gear 50 that engages with the feeding-roller drive gear 44*b* rotates to cause the feeding roller 12 to rotate in the sheet conveying direction. As the separation roller cam 44*a* rotates, the separation roller arm 48 swings to cause the separation roller 13 to come into contact with and separate from the feeding roller 12. As the sheet-return lever cam 44*c* rotates, the sheet-return lever arm 49 swings to return the leading edge of the sheet stack. The feeding-roller drive gear 44*b* has a toothed portion and a non-toothed portion. When the toothed portion of the feeding-roller drive gear 44*b* engages with the feeding roller gear 50, a driving force is transmitted to the feeding roller gear 50. However, when the non-toothed portion is located at the position where it engages with the feeding-roller drive gear, a driving force is not transmitted to the feeding roller gear 50.

As the main cam unit 46 rotates, the guide-shift lever cam 43, which is a second cam, rotates to drive the guide-shift lever gear unit 47, which then causes the guide shift lever 28 to pivot. That is, as illustrated in FIG. 10, a cam portion 43*a* integrally formed with the guide-shift lever cam 43 turns to come into contact with a cam follower 47*a* of the guide-shift lever gear unit 47, thereby causing the cam follower 47*a* to turn. When a gear 47*b* of the guide-shift lever gear unit 47 rotates by a predetermined angle, a gear portion 28*c* of the guide shift lever 28, the gear portion 28*c* engaging with the gear 47*b*, rotates. As the gear portion 28*c* rotates, the guide shift lever 28 pivots to raise the left and right side-edge guide shift members 25 and 27. The left and right sheet-side-edge guides 19 and 20 are thus separated from the sheet-stack side edges. This state is maintained during recording, and the left and right sheet-side-edge guides 19 and 20 are spaced from the sheet-stack side edges as illustrated in FIG. 5B.

With this configuration, when a feeding operation starts, the feeding drive motor 41 rotates the feeding control cam 44, which then causes the feeding roller gear 50 engaging with the feeding-roller drive gear 44*b* to rotate. This causes the feeding roller 12 to rotate in the sheet conveying direction. Next, the pressure plate cam 45 separates the pressure plate 11 from the feeding roller 12. The leading edge of the sheet 16*a* fed by the feeding roller 12 comes into contact with the nip between the conveying roller 31 and the pinch roller 32 which are at a standstill. A skew of the sheet 16*a* is thus corrected. After the skew correction, another motor causes the conveying roller 31 to start conveying the sheet 16*a*. After the conveying roller 31 starts to convey the sheet 16*a* and before the recording means 35 starts a recording operation, the separation roller cam 44*a* separates the separation roller 13 from the feeding roller 12. Next, as the feeding-roller drive gear 44*b* rotates, the non-toothed portion of the feeding-roller drive gear 44*b* is brought to a position opposite the feeding roller gear 50. Thus, transmission of a driving force to the feeding roller 12 is stopped. After the conveying roller 31 and the pinch roller 32 start to convey the sheet 16*a* and before the recording means 35 starts a recording operation, the guide-shift lever cam 43 separates the left and right sheet-side-edge guides 19 and 20 from the sheet side edges to reduce frictional resistance of the sheet side edges. The separation of the sheet-side-edge guides 19 and 20 from the sheet side edges may be done either before or after the separation of the separation roller 13 from the feeding roller 12, or even after transmission of a driving force to the feeding roller 12 is stopped. In this state, the feeding drive motor 41 stops, the sheet 16*a* is conveyed by the conveying roller 31, and the recording head 35 performs recording on the sheet 16*a*.

Upon completion of recording on the sheet 16*a*, the feeding drive motor 41 is driven to start an operation of feeding the second sheet 16*b*. Before the toothed portion of the feeding-roller drive gear 44*b* having been started to rotate by the feeding drive motor 41 is brought into engagement with the feeding roller gear 50, the cam portion 43*a* is separated from the cam follower 47*a* by rotation of the guide-shift lever cam 43. This allows the guide shift lever 28 to pivot by its own weight clockwise in FIG. 10. The guide shift member 25 is moved downward by the spring 25*c* and causes the left and right sheet-side-edge guide members 19 and 20 to move toward the side edges of the second sheet 16*b*. After stable positional accuracy of the second sheet 16*b* in the width direction is ensured, the toothed portion of the feeding-roller drive gear 44*b* is brought into engagement with the feeding roller gear 50, and the second sheet 16*b* is fed by the feeding roller 12.

As described above, in the present apparatus, the swinging motion of the pressure plate 11, the rotating motion of the feeding roller 12, the swinging motion of the separation roller 13, the swinging motion of the sheet return lever 14, and the swinging motion of the guide shift lever 28 are all controlled by the same main cam unit 46. This can prevent time lags between motions of these elements. It is thus possible to control precise motions on the basis of relationships between motions of these elements. Additionally, as illustrated in FIG. 8 and FIG. 9, the axial direction of the feeding drive motor 41, the axial direction of the main cam unit 46, the axial direction of the feeding roller 12, the axial direction of the separation roller 13, the pivot axis direction of the sheet return lever 14, and the pivot axis direction of the guide shift lever 28 are all substantially parallel to each other. Therefore, the configuration of the feeding-unit drive system does not require any complicated mechanism for conversion of drive directions etc., and thus does not significantly affect the overall size of the apparatus.

Second Embodiment

In the first embodiment, the feeding roller 12 has a round shape as illustrated in FIG. 1. During recording, the separation roller 13 is separated from the feeding roller 12 and transmission of a driving force to the feeding roller 12 is stopped. The feeding roller 12 is rotated in a dragged state by movement of a sheet, and thus a back tension on the sheet from the feeding roller 12 and the separation roller 13 can be reduced.

A second embodiment adopts a so-called D-shaped feeding roller having both round and flat outer surfaces. During recording, the feeding roller is stopped such that the flat outer face is located opposite a sheet. Thus, a back tension on the sheet from the feeding roller and the separation roller can be reduced. In the present embodiment, frictional resistance of both side edges of a sheet stack can be reduced, as in the case of the first embodiment described above.

Third Embodiment

A third embodiment adopts a so-called swing-arm feeding device in which a feeding roller is rotatably supported at an end of an arm that pivots about a fixed axis. In the third embodiment, a drive shaft is mounted to the fixed axis side of the arm. A driving force from the drive shaft is transmitted through an idler gear supported in the middle of the arm to the feeding roller. When, through transmission delay means in the transmission path from the drive shaft to the feeding roller, the feeding roller is rotated at a speed higher than a driving speed of the drive shaft, the feeding roller is brought to a dragged state. The pressure plate disposed opposite the feeding roller is in a fixed state. In accordance with the thickness of a sheet, the swing arm swings relative to the pressure plate.

In addition to mounting the swing-arm feeding unit described above, the conveyance speed of the conveying roller is set to be slightly higher than that of the feeding roller. Then, when the conveying roller starts to convey a sheet, the feeding roller is rotated in a dragged state by the transmission delay means and a difference in peripheral speed between these rollers. A back tension from the feeding roller to the sheet is thus reduced. In the present embodiment, frictional resistance of both side edges of a sheet stack can be reduced, as in the case of the first embodiment described above.

According to the embodiments described above, it is possible to reduce back tension on a recording medium during a recording operation while preventing the second and following recording media loaded on the pressure plate from being poorly aligned, folded at their edges, scratched, etc. It is thus possible to achieve stable loading of recording media, accurate registration during a feeding operation, and accurate conveyance of a recording medium during a recording operation.

Also, a back tension between feeding means and separation means during a recording operation can be reduced, and more accurate conveyance of a recording medium can be achieved.

Additionally, guide members on a pressure plate member are provided with moving means different from that for side-edge guide members in the guide members. Therefore, the moving resistance of the moving means for the guide members on the pressure plate member can be adjusted to a value that is most appropriate in terms of usability.

The side-edge guide members can be moved with a simple configuration and thus a size reduction of the apparatus can be achieved.

Also, a simple configuration of the drive system can be realized and a further size reduction of the apparatus can be achieved.

The second and following recording media can be conveyed with high accuracy. Thus, during feeding and recording operations on all the recording media, both stable loading and high conveying accuracy can be achieved.

According to the present invention, it is possible to provide a feeding device that can achieve high conveying accuracy by reducing back tension on a recording medium being conveyed during a recording operation, and can reduce occurrence of poor alignment of side edges of recording media loaded.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/050230, filed Jan. 12, 2010, which is hereby incorporated by reference herein in its entirety.

What is claimed is:

1. A feeding device comprising:

a pressure plate on which recording media are loaded;

feeding means for feeding the recording media loaded on the pressure plate;

a regulating member configured to regulate a position of a side edge of the recording media loaded on the pressure plate;

supporting means for supporting the regulating member, the supporting means having a bottom portion on which the recording media loaded on the pressure plate are partially loaded;

conveying means for conveying the recording medium fed by the feeding means; and moving means for separating the regulating member from the side edge of the recording media loaded on the pressure plate, wherein the feeding means starts to feed the recording medium while the position of the side edge of the recording media is being regulated by the regulating member, and wherein the moving means moves the regulating member without moving the bottom portion; and the moving means separates the regulating member from the side edge of the recording media after the conveying means starts to convey the recording medium.

2. The feeding device according to claim 1, wherein the moving means has a cam member that is movable relative to the supporting means and comes into contact with the regulating member, and the regulating member is moved by movement of the cam member.

3. The feeding device according to claim 2, wherein the moving means has biasing means for biasing the regulating member in a direction away from the side edge of the recording media, and the cam member moves in a first direction to press the regulating member against a biasing force of the biasing means and move the regulating member in a direction toward the side edge of the recording media.

4. The feeding device according to claim 3, wherein the cam member moves in a second direction opposite the first direction to cause the regulating member to be moved by the biasing force of the biasing means in the direction away from the side edge of the recording media.

5. The feeding device according to claim 4, further comprising second biasing means for biasing the cam member in the first direction.

6. The feeding device according to claim 5, further comprising a cam-member moving member configured to move the cam member, wherein the cam-member moving member causes the cam member to be moved by movement of a second cam rotating in synchronization with rotation of a gear that transmits a driving force to the feeding means.

7. The feeding device according to claim 1, wherein the regulating member is disposed on both sides of the recording media to be loaded to regulate both edges of the recording media.

8. The feeding device according to claim 1, wherein the supporting means can be moved to fit a size of the recording media to be loaded.

9. The feeding device according to claim 1, further comprising separation means for pressing the recording medium against the feeding means and blocking recording media not in contact with the feeding means from advancing, wherein the separation means separates from the feeding means after the conveying means starts to convey the recording medium.

10. A recording apparatus comprising:

a pressure plate member on which recording media are loaded;

a feeding unit for feeding each of the recording media;

a side-edge guide member configured to guide a side edge of the recording media loaded on the pressure plate member;

a conveying unit disposed downstream of the feeding unit in the recording-medium conveying direction; and a recording unit disposed downstream of the conveying unit in the recording-medium conveying direction, wherein the pressure plate member is disposed swingably in a direction toward and away from the feeding unit, and the side-edge guide member is movable relative to the pressure plate member in a direction crossing the recording-medium conveying direction;

the pressure plate member separates from the feeding unit after the feeding unit starts to feed the recording medium and before the recording unit starts a recording operation on the recording medium;

the side-edge guide member moves in a direction away from the side edge of the recording media after the conveying unit starts to convey the recording medium having reached the conveying unit and before the recording unit starts a recording operation on the recording medium; and a guide member mounted on the pressure plate member and movable relative to the pressure plate member in the direction crossing the recording-medium conveying direction, wherein the side-edge guide member is mounted on the guide member and is movable relative to the guide member in the direction crossing the recording-medium conveying direction.

11. The recording apparatus according to claim 10, further comprising a separation unit disposed downstream of the pressure plate member and opposite the feeding unit, wherein after the conveying unit starts to convey the recording medium having reached the conveying unit and before the recording unit starts a recording operation on the recording medium, the separation unit separates from the feeding unit and transmission of a driving force to the feeding unit is stopped.

12. The recording apparatus according to claim 10, further comprising a lever member pivotally supported opposite a holding surface of the pressure plate member, the holding surface being a surface on which the recording media are loaded, wherein the side-edge guide member is moved in the direction away from the side edge of the recording media by causing the lever member to pivot.

13. The recording apparatus according to claim 12, wherein pivoting of the lever member, swinging of the pressure plate member and rotation of the feeding unit are driven by one drive source.

14. The recording apparatus according to claim 10, wherein after the recording unit completes the recording operation on the recording medium and before feeding of the next recording medium starts, the side-edge guide member moves in a direction toward a side edge of the next recording medium.

15. A feeding device comprising:

a pressure plate on which recording media are loaded;

a feeding unit for feeding the recording media loaded on the pressure plate;

a regulating member configured to regulate a position of a side edge of the recording media loaded on the pressure plate;

a supporting unit mounted on the pressure plate for supporting the regulating member, the supporting unit being movable relative to the pressure plate member in the direction crossing the recording media conveying direction;

a conveying unit disposed downstream of the feeding unit in the recording media conveying direction; and wherein the regulating member is movable relative to the supporting unit in a direction crossing the recording-medium conveying direction;

the regulating member moves in a direction away from the side edge of the recording media after the conveying unit starts to convey the recording medium having reached the conveying unit.

16. A feeding device according claim 15, wherein the regulating member is movable relative to the supporting unit without moving the supporting unit.

* * * * *